US008180270B2

(12) United States Patent
Yasutomi et al.

(10) Patent No.: US 8,180,270 B2
(45) Date of Patent: May 15, 2012

(54) IMAGE FORMING APPARATUS FOR CONTROLLING GLOSSINESS OF AN IMAGE

(75) Inventors: Kei Yasutomi, Yokohama (JP); Hitoshi Maruyama, Tokyo (JP); Masanori Saitoh, Komae (JP); Takeo Tsukamoto, Yokohama (JP); Katsuhiro Aoki, Yokohama (JP); Katsuaki Miyawaki, Yokohama (JP); Eisaku Murakami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 320 days.

(21) Appl. No.: 12/144,267

(22) Filed: Jun. 23, 2008

(65) Prior Publication Data

US 2009/0003904 A1 Jan. 1, 2009

(30) Foreign Application Priority Data

Jun. 26, 2007 (JP) ..... 2007-167213

(51) Int. Cl.
*G03G 15/20* (2006.01)

(52) U.S. Cl. ..... 399/341; 399/67; 399/320; 399/328; 399/330; 399/331; 399/335; 399/336

(58) Field of Classification Search ..... 399/67, 399/320, 328, 330, 331, 335, 336, 341
See application file for complete search history.

(56) References Cited

U.S. PATENT DOCUMENTS

| | | | | |
|---|---|---|---|---|
| 5,784,679 | A * | 7/1998 | Schlueter et al. | 399/335 |
| 2002/0102118 | A1* | 8/2002 | Kosugi et al. | 399/341 |
| 2005/0244203 | A1* | 11/2005 | Kamiyama | 399/341 |
| 2005/0254846 | A1 | 11/2005 | Yura et al. | |
| 2006/0067757 | A1* | 3/2006 | Anderson et al. | 399/341 |
| 2007/0053731 | A1* | 3/2007 | Mori et al. | 399/341 |
| 2007/0086803 | A1* | 4/2007 | Kimura et al. | 399/69 |
| 2007/0212126 | A1 | 9/2007 | Seto et al. | |
| 2007/0212129 | A1 | 9/2007 | Takemoto et al. | |
| 2007/0218386 | A1 | 9/2007 | Suzuki et al. | |
| 2008/0008505 | A1 | 1/2008 | Seto et al. | |
| 2008/0013975 | A1 | 1/2008 | Yasutomi et al. | |
| 2008/0056784 | A1 | 3/2008 | Nakamura et al. | |
| 2008/0056785 | A1 | 3/2008 | Maruyama et al. | |
| 2008/0069610 | A1 | 3/2008 | Nakafuji et al. | |

FOREIGN PATENT DOCUMENTS

| | | | |
|---|---|---|---|
| JP | 4-31393 | | 5/1992 |
| JP | 07311505 | A * | 11/1995 |
| JP | 09265243 | A * | 10/1997 |
| JP | 10-3191 | | 1/1998 |
| JP | 2000-155485 | | 6/2000 |

(Continued)

OTHER PUBLICATIONS

JP 09265243 A, English Abstract to Koyama et al.*

(Continued)

*Primary Examiner* — Ryan Walsh

(74) *Attorney, Agent, or Firm* — Oblon, Spivak, McClelland, Maier & Neustadt, L.L.P.

(57) ABSTRACT

An image forming apparatus includes a fixing unit and a re-heating unit. The fixing unit fixes a toner image on a recording medium by applying heat to the toner image with a first glossiness level. The re-heating unit re-heats the toner image, fixed on the recording medium by the fixing unit, to set a second glossiness level lower than the first glossiness level.

12 Claims, 9 Drawing Sheets

FOREIGN PATENT DOCUMENTS

| | | |
|---|---|---|
| JP | 2002-304072 | 10/2002 |
| JP | 2003-76201 | 3/2003 |
| JP | 2003-263046 | 9/2003 |
| JP | 2005-114832 | 4/2005 |
| JP | 2005-115132 | 4/2005 |
| JP | 2005-140994 | 6/2005 |
| JP | 2005-283654 | 10/2005 |
| JP | 2005-284048 | 10/2005 |
| JP | 3665693 | 4/2008 |

OTHER PUBLICATIONS

JP 07311505 A, English Abstract to Kamiya.*

Japanese Office Action Issued Feb. 3, 2012, in Japanese Patent Application No. 2007-167213, filed Jun. 26, 2007, 2 pages.

* cited by examiner

FIG. 5

| RECORDING MEDIUM | MAKER | 60-DEGREE GLOSSINESS | EXAMPLE1 | | COMPARATIVE EXAMPLE1 | | COMPARATIVE EXAMPLE2 | | COMPARATIVE EXAMPLE3 | |
|---|---|---|---|---|---|---|---|---|---|---|
| | | | GL | G | GL | G | GL | G | GL | G |
| PPC PAPER (TYPE 6000 70W) | RICOH | 5% | × | ○ | ○ | ○ | × | ○ | × | × |
| OK KASAO | OJI | 6% | ○ | ○ | △ | ○ | × | ○ | △ | × |
| OK CASABLANCA | OJI | 25% | ○ | ○ | × | ○ | × | ○ | ○ | × |
| OK CASABLANCA X | OJI | 40% | ○ | ○ | × | ○ | × | ○ | ○ | × |
| FC ART PAPER | NBS RICOH | 50% | ○ | ○ | × | ○ | × | ○ | ○ | × |
| FC GLOSINESS PAPER | NBS RICOH | 100% | × | ○ | × | ○ | ○ | ○ | × | × |

GL: EVENNESS OF GLOSSINESS
○: NO DISCOMFORT IS OBSERVED
△: SOME DISCOMFORT IS OBSERVED
×: STRONG DISCOMFORT IS OBSERVED

G: GRAININESS
○: NOT OBSERVED
△: OBSERVED BUT NO DISCOMFORT
×: OBSERVED WITH STRONG DISCOMFORT

IMAGE FORMING APPARATUS FOR CONTROLLING GLOSSINESS OF AN IMAGE

CROSS-REFERENCE TO RELATED APPLICATIONS

This application claims priority from Japanese Patent Application No. 2007-167213, filed on Jun. 26, 2007 in the Japan Patent Office, the entire contents of which are hereby incorporated by reference herein.

BACKGROUND OF THE INVENTION

1. Field of the Invention

The present disclosure generally relates to an image forming apparatus using electrophotography, and more particularly to an image forming apparatus for forming images on recording media having different glossiness.

2. Description of the Background Art

In general, image forming apparatuses are configured to output images, such as a toner image, on a recording medium by changing glossiness of images.

Recently, market demand has been growing for producing images having a variety of glossiness by using image forming apparatuses employing electrophotography. More specifically, although users have long been using image forming apparatuses for producing images on plain paper having lower glossiness, widely used in business fields, more are now demanding higher quality images for image forming apparatuses, wherein such higher quality images may be images formed on a recording medium having higher glossiness, such as art paper, coated paper, or fine coated paper. In this disclosure, a recording medium having lower glossiness has greater microscopic asperities on the surface, and a recording medium having higher glossiness has smaller microscopic asperities on the surface.

However, conventional techniques may not be suitable for producing images having an optimal glossiness and uniform glossiness on various recording media having different glossiness because graininess of images may deteriorate in the conventional techniques. In other words, it may be difficult to form images having optimal glossiness and uniform glossiness on recording media in a stable manner by the conventional techniques.

In this disclosure, "uniform glossiness" or "evenness of glossiness" means the level of evenness of glossiness of a recording medium having a toner image thereon. Further, "graininess" means the level of graininess of toner image formed on a recording medium. Both "evenness of glossiness" and "graininess" are important factors for evaluating image quality.

The following factors may cause lower "evenness of glossiness." (1) Difference of image concentration resulting in difference of image glossiness on a recording medium, by which sense of discomfort is perceived by eye observation (visual observation), in which the difference of image concentration is caused by difference of toner adhesion amount on the recording medium. (2) Difference of glossiness between a recording medium and a glossiness of image-formed area causes sense of discomfort perceived by eye observation (visual observation). Accordingly, to enhance evenness of glossiness of image, it is required to set a similar glossiness level for an entire image-formed area including higher image concentration area and lower image concentration area, and to set a similar glossiness level for a recording medium and image-formed area (toner adhesion area).

As for a lower glossiness recording medium, such as plain paper or the like, a conventional fixing unit having no function for changing glossiness level or for producing higher glossiness can be used to produce images having allowable level of image quality. However, such conventional fixing unit may not be suitable for producing a higher quality image on a recording medium having higher glossiness, such as coated paper. More specifically, such conventional fixing cannot produce a higher quality image as follows.

A recording medium having smaller surface irregularity has a higher glossiness. For example, such recording medium has a 60-degree specular glossiness value of 10% to 80%. When a toner image is formed on such recording medium, it may increase surface irregularity, by which the glossiness level of whole image decreases. As a result, a difference is observed in a level or degree of glossiness between the recording medium and a toner image area. If the difference or contrast between glossiness becomes too great, an observer is apt to feel that the image quality is poor.

Further, another drawback may occur when an image is output on a recording medium having higher glossiness (or smaller surface irregularity).

In an electrophotography process, a toner image is formed using an area coverage modulation method to reproduce the image having suitable image concentration. The area coverage modulation is used to reproduce image gradation of an image by changing an area ratio between a toner-adhered area and a toner-not-adhered area. When an image area having middle (or intermediate) concentration area is formed, such image area may include the toner-adhered area and the toner-not-adhered area, wherein the toner-not-adhered area is a surface of recording medium not adhered with toner (i.e., exposed surface of recording medium). Accordingly, toner particles are adhered in a patch-work manner on the recording medium having a smaller surface irregularity, and the toner-adhered area on the recording medium has a greater surface irregularity.

When an image area ratio is small, a higher glossiness can be attained because a ratio of the toner-adhered area to a recording medium as a whole having higher glossiness is small. However, at intermediate image area ratios, a lower glossiness may be observed on the resultant image because a greater number of surface irregularity portions may exist between toner-adhered area and the exposed surface of the recording medium. Further, at high image area ratios, the glossiness level may become higher or lower depending on melted condition of toner. Therefore, because the glossiness is changed due to an image area ratio, glossiness difference may occur in one output image, and thereby an image having a lower level of evenness of glossiness may be output.

One conventional approach involves use of a technique that outputs images by switching over image glossiness between lower and higher glossiness using a transfer/fixing unit so that images can be output with desired glossiness for all types of images, such as photography image, monochrome image, and so forth, by which a user may not feel sense of discomfort on glossiness of output images.

In such technique, a switching over of glossiness is conducted by (1) changing a contacting time between a second image carrying member and a recording medium or by (2) changing a pressure applied to a toner image carried on a second image carrying member. With such configuration, images having optimal glossiness can be output on various recording media having different glossiness. However, such technique may output image having degraded graininess in some cases. Especially when fixing conditions are changed from a lower glossiness image to a middle glossiness image (or a higher glossiness image), a toner image may be transferred to a contacting member during a fixing process, by which an output image may have a lower graininess.

Another conventional technique outputs images having desired glossiness without changing a temperature or linear velocity of a fixing device of a second fixing unit disposed after a first fixing unit, in which the second fixing unit is disposed at a position where temperature of toner images is still at a glass transition point or higher.

In such technique, the first fixing unit applies heat to a toner image under a pressurized condition to fix the toner image on a recording medium, and then the toner image on the recording medium is re-pressurized by the second fixing unit having no heating device. Accordingly, images having optimal glossiness can be output on various recording media having different glossiness.

However, the second fixing unit only re-pressurizes the toner image because a heating device is not disposed. Accordingly, a temperature condition of toner image fixed by the second fixing unit may not be stabilized, and thereby an image output from the second fixing unit may not have a desired glossiness. Especially when installation environment of an image forming apparatus changes, a temperature condition of toner image fixed by the second fixing unit also changes and thereby an image output from the second fixing unit may not have a desired glossiness.

Further, another conventional technique in which a second fixing unit, disposed after a first fixing unit, fixes toner images on both faces of a recording medium simultaneously so as to efficiently form higher quality toner images on both faces of a recording medium as a photographic image. Although such technique can be used to form a toner image having higher glossiness on a recording medium having higher glossiness (e.g., 60-degree specular glossiness value of 80% or more), such technique may not be useful for producing images having optimal glossiness on plain paper or the like. For example, such technique may not form a toner image having an optimal glossiness on a recording medium of intermediate glossiness (e.g., 60-degree specular glossiness value of 10% to 60%), which has a lower glossiness than a recording medium having higher glossiness.

Finally, another conventional technique has a fixing unit that applies heat to a toner image under a pressurized condition to fix the toner image on a recording medium, after which the toner image on the recording medium is cooled and separated by a cooling and separation unit so as to form a smooth color image having higher glossiness on the recording medium. The cooling and separation unit uses a belt contactable to a toner image so that toner image can be transferred with surface shape of the belt, such as roughness. Accordingly, glossiness of toner image can be controlled by changing a surface property of the belt between mirror-finished surface (or higher glossiness), middle glossiness, and lower glossiness. Specifically, several belts having different surface property (or different surface irregularity) can be prepared, and by replacing belts, glossiness of toner image can be optimized for recording media having various glossiness.

However, such belt replacement configuration may be inconvenient for user operability. Further, if a belt having surface property of middle glossiness to lower glossiness (60-degree specular glossiness value of 60% or less) is used instead of mirror-finished surface for cooling and separation, some toner may adhere on the belt of the fixing unit. If such toner adhered phenomenon occurs, graininess of image on a recording medium may be degraded.

In view of such situation, an image forming apparatus which can produce images having a good level of graininess and uniform glossiness on various recording media having various glossiness is desired.

SUMMARY

In an aspect of the present disclosure, an image forming apparatus includes a fixing unit and a re-heating unit. The fixing unit fixes a toner image on a recording medium by applying heat to the toner image with a first glossiness level. The re-heating unit re-heats the toner image, fixed on the recording medium by the fixing unit, to set a second glossiness level lower than the first glossiness level.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 5 shows experiment conditions and results using a fixing unit and a re-heating unit according to an exemplary embodiment and a conventional fixing unit;

Figure 1:
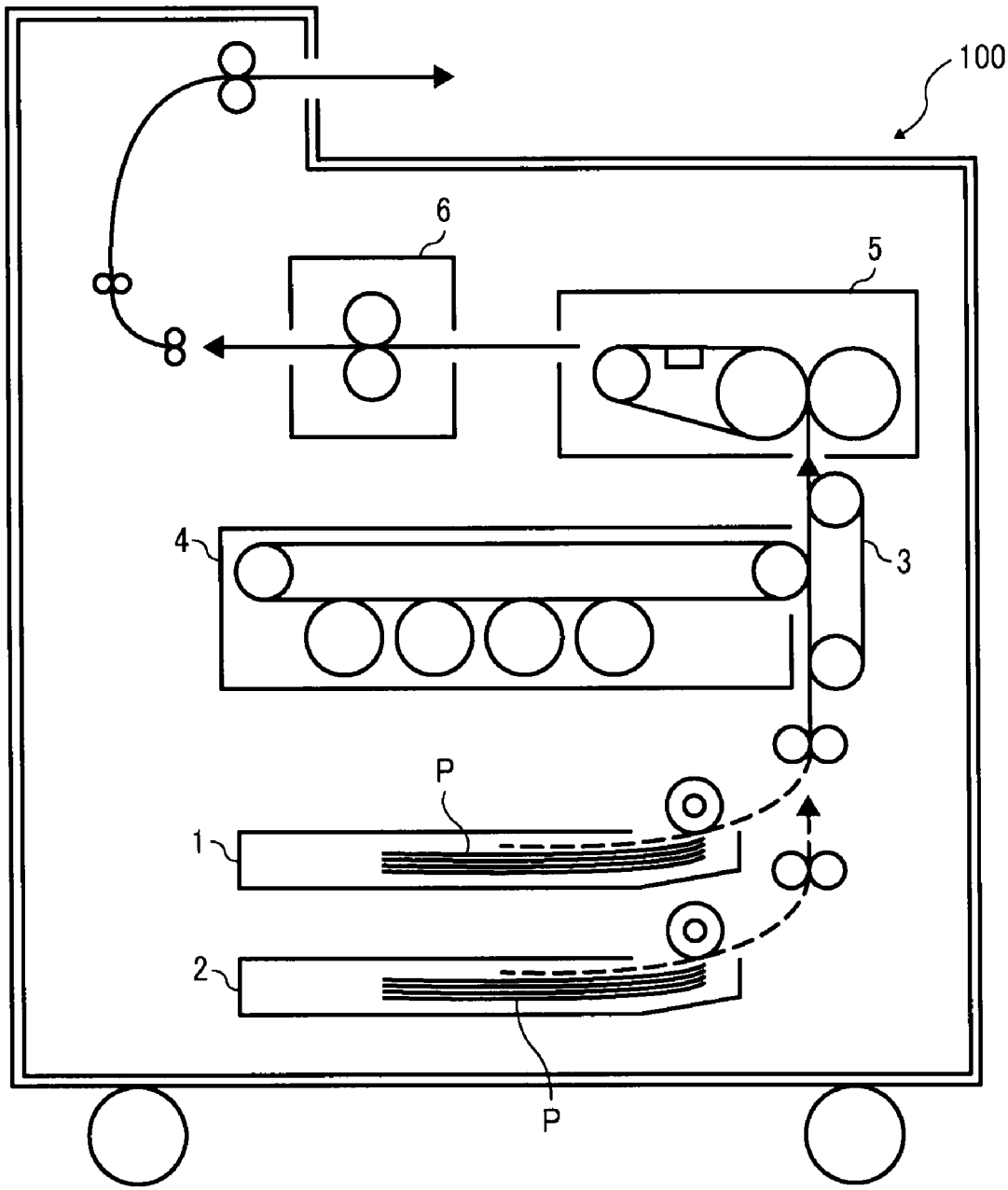
FIG. 1 illustrates a schematic configuration of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to FIGS. 1 to 5. The image forming apparatus may employ electrophotography, for example, but not limited thereto.

Figure 2:
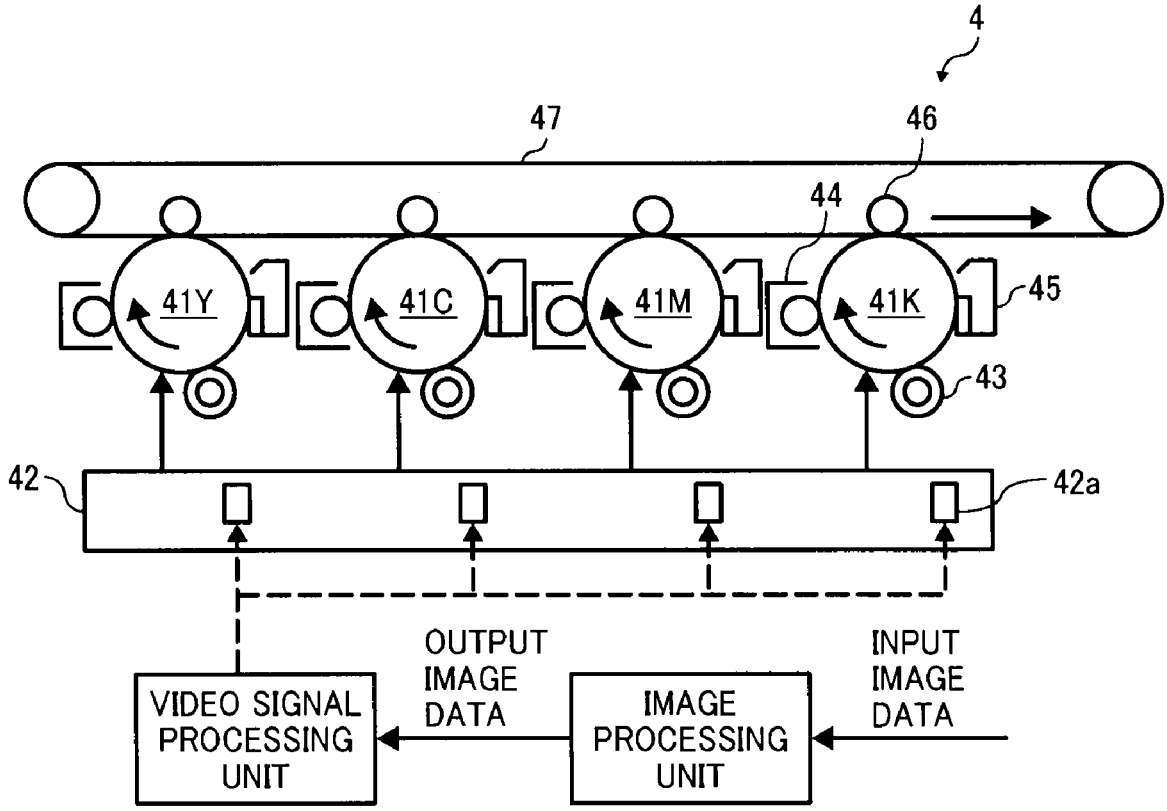
FIG. 2 illustrates a schematic configuration of an image forming engine of the image forming apparatus of FIG. 1.
Figure 3:
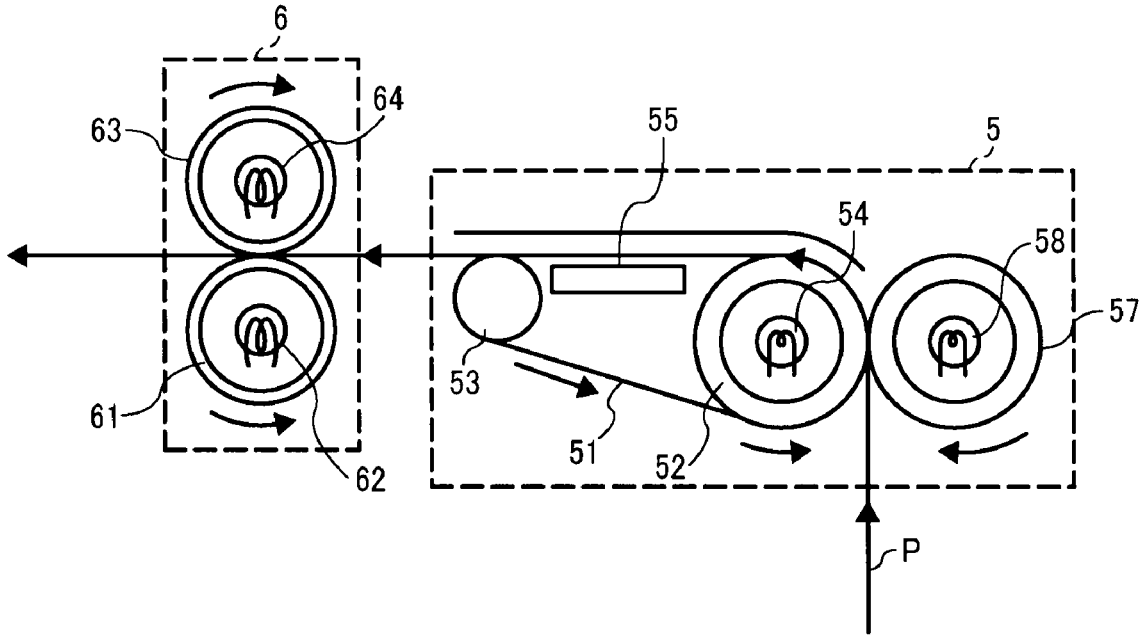
FIG. 3 illustrates a schematic configuration of a fixing unit and a re-heating unit according to an exemplary embodiment.

A description is now given to a configuration and operation of an image forming apparatus 100 with reference to FIGS. 1 to 3. FIG. 1 illustrates a configuration of the image forming apparatus 100, such as a printer, and FIG. 2 illustrates an expanded view of an image forming engine of the image forming apparatus 100. FIG. 3 illustrates an expanded view of a fixing unit and a re-heating unit of the image forming apparatus 100 according to a first exemplary embodiment. As illustrated in FIG. 1, the image forming apparatus 100 includes sheet cassettes 1 and 2, an image forming engine 4, a fixing unit 5, and a re-heating unit 6, for example.

The sheet cassettes 1 and 2, disposed at an under part of the image forming apparatus 100, store a given volume of recording medium P, such as sheet. The recording medium P may be: plain paper used for copier and printer in office; enamel (or coated) paper, such as cast coated paper, art paper, fine coated paper; non-coated paper, such as bond paper (quality paper), medium quality paper, lower quality paper, or the like. Further, the recording medium P may be a plastic sheet, such as OHP (overhead projector) sheet made of PET (polyethylene terephthalate), for example.

As described later, the image forming apparatus 100 can output higher quality images having good level of evenness of glossiness and graininess on the recording medium P having middle level of glossiness, especially. Accordingly, higher quality image can be output on the recording medium P having 60-degree specular glossiness value of 10% to 60%, such as enamel (or coated) paper including cast coated paper, art paper, and fine coated paper.

A description is now given to an operation of the image forming apparatus 100. The recording medium P is transported to an upper part of the image forming apparatus 100 from the sheet cassette 1 or 2 via a transport route. The transport belt 3 transports the recording medium P by carrying the recording medium P thereon. The image forming engine 4 forms superimposed color toner images of yellow (Y), cyan (C), magenta (M), and black (K), and transfers the color image onto the recording medium P carried on the transport belt 3. The recording medium P is further transported to an upper part of the image forming apparatus 100 by the transport belt 3. A description of a configuration and operation of the image forming engine 4 is described later with reference to FIG. 2.

Then, the recording medium P is transported to the fixing unit 5, in which heat and pressure are applied to the toner image to fix the toner image on the recording medium P. After fixing the toner image by the fixing unit 5, the toner image is cooled by a heat pipe 55, used as a cooling device, and then the recording medium P is separated from a cooling/separation belt 51 and ejected from the fixing unit 5. The fixing unit 5 is described later with reference to FIG. 3.

The recording medium P is then transported to the re-heating unit 6 from the fixing unit 5 as shown in FIG. 1. The re-heating unit 6 re-heats the toner image fixed on the recording medium P in the fixing unit 5 to decrease glossiness of the toner image from a first glossiness level to a second glossiness level, in which the first glossiness level is a glossiness before re-heating (or before the recording medium P passes through the re-heating unit 6) and the second glossiness level is a glossiness after re-heating (or after the recording medium P passed through the re-heating unit 6). As such, the re-heating unit 6 function as a surface property modification unit for modifying surface property of output image. Accordingly, after passing through the re-heating unit 6, the glossiness of the toner image can be adjusted to glossiness of the recording medium P.

Accordingly, an image having good level of evenness of glossiness is formed on the recording medium P. Then, the recording medium P is transported to an upper part of the image forming apparatus 100, and ejected from the image forming apparatus 100. A description of configuration and operation of the fixing unit 5 and the re-heating unit 6 are given later with reference to FIG. 3.

A description is now given to a configuration and operation of the image forming engine 4 with reference to FIG. 2. As illustrated in FIG. 2, the image forming engine 4 forms a superimposed color image of yellow (Y), cyan (C), magenta (M), and black (K) on the recording medium P. The image forming engine 4 includes photoconductor drums 41Y, 41C, 41M, and 41K disposed in tandem under an intermediate transfer belt 47. A charging process, an exposure process, and a developing process are conducted on the photoconductor drums 41Y, 41C, 41M, and 41K to form toner images of each color. The toner images formed on the photoconductor drums 41Y, 41C, 41M, and 41K are sequentially transferred to the intermediate transfer belt 47 at a position of a primary transfer roller 46. The intermediate transfer belt 47 travels at a given timing using a driver (not shown), and the toner images are superimposed and transferred on the intermediate transfer belt 47 at given positions. The superimposed toner images are then transferred to the recording medium P transported by the transport belt 3.

Because an image forming process on the photoconductor drums 41Y, 41C, 41M, and 41K are similar one another, an image forming process is described by one color without referring specific colors. As illustrated in FIG. 2, the photoconductor drum 41 is surrounded by an optical writing unit 42, a charging device 43, a development unit 44, a primary transfer unit 46, and a cleaning unit 45, for example. The charging device 43 charges the photoconductor drum 41 to a given potential. The optical writing unit 42 writes a latent image on the charged photoconductor drum 41 based on image data, wherein the image data is processed as described later. The development unit 44 develops a latent image on the photoconductor drum 41 as a toner image using each colors of toner. The primary transfer unit 46 transfers the toner image from the photoconductor drum 41 to the intermediate transfer belt 47. The cleaning unit 45 cleans toner remaining on the photoconductor drum 41 after transferring the toner image to the intermediate transfer belt 47.

A description is now given to an image processing unit, which generates output image data from input image data. Image data is input to an image forming apparatus from a scanner, if copier is used as image forming apparatus, or a personal computer connected to the image forming apparatus, if a printer is used as image forming apparatus. Such image data may be RGB (red, green, blue) image data having multiple value (8 bit data in general), and processed by a MTF (modulation transfer function) filtering processor in the image processing unit. The RGB image data is then converted to CMYK data by color analysis method. The CMYK data is processed by a gradation correction unit (γ conversion unit) to control concentration so as to produce a gradation set in advance for image. Then, a quasi-halftone processing unit processes the data to adjust the data to a printer characteristic, and transmits output image data (e.g., 600 dpi, 4 bit data) to a video signal processing unit.

A description is now given to data flow in the video signal processing unit. Although the video signal processing unit is allocated for each of YCMK, data flow of one color, such as Y color, is described because a similar process is conducted for each of colors. The video signal processing unit receives the output image data, processed by the image processing unit, and stores data on a line memory, wherein the number of data is same as the number of light emitter 42*a* (e.g., laser diode). Then, the data on the line memory, corresponding to each pixel, is transmitted to a PWM (pulse-width modulation) controller at a given timing (i.e., pixel clock) with a signal synchronized to a rotation of a polygon mirror. The number of light emitter 42*a* is one for each color, for example. The PWM controller converts the data to PWM signal, and then transmits the PWM signal to a LD (laser diode) driver. The LD driver drives LD elements to emit a given light intensity based on the PWM signal. A PWM control is conducted for output image data for each color so as to modulate a laser beam. Light emitted from the LD element passes through a collimate lens to set the light as parallel light, and a desired beam spot diameter is set by passing the light in an aperture. Then, the light beam passes through a cylindrical lens, and enters the polygon mirror. The light beam reflected on the polygon mirror enters a scan lens (f-theta lens), reflects on a reflection mirror, and focuses on the photoconductor drum 41 to form an electrostatic latent image on the photoconductor drum 41. The electrostatic latent image is then developed as a toner image, and further transferred to the recording medium P.

A description is now given to toner used in an exemplary embodiment. The toner may be polymerization toner prepared by a polymerization method. Further, the toner may include a wax as releasing agent so as to fix a toner image in an oil-less manner in the fixing unit 5 and to facilitate a separation of toner image from a re-heat roller 61 of the re-heating unit 6. Further, the toner may have a volume average particle diameter of 5.5 μm, for example. The toner particle diameter can be measured using an instrument COULTER COUNTER TA-II from Coulter Electrons Inc., with an aperture of 100 μm. The toner for yellow (Y), cyan (C), magenta (M), and black (K) are prepared by a similar method. Although the polymerization toner prepared by a polymerization method is used in exemplary embodiments, toner prepared by other method, such as dispersion polymerization method, pulverization method, can be also used.

A description is now given to a configuration and operation of the fixing unit 5 and the re-heating unit 6 with reference to FIG. 3. As illustrated in FIG. 3, the fixing unit 5 includes a heat roller 52, a pressure roller 57, a cooling/separation belt 51 as a contacting member, a heat pipe 55 as a cooling device, and a separation roller 53, for example. The cooling/separation belt 51 is extended by the heat roller 52 and the separation roller 53. The heat roller 52 has a heater 54, such as halogen heater, as a heat source therein. The heat pipe 55 is disposed downstream side of the heat roller 52 and an inner face side of the cooling/separation belt 51 to cool the cooling/separation belt 51. The pressure roller 57 presses the heat roller 52 via the cooling/separation belt 51 to form a nip portion therebetween. The pressure roller 57 has a heater 58, such as halogen heater, as a heat source therein.

The cooling/separation belt 51 may include a base layer, an elastic layer, and a surface layer, for example. The base layer may be polyimide film having a thickness of 70 μm dispersed with conductive carbon. The elastic layer may be silicone rubber having a thickness of 100 μm formed on the base layer. The surface layer may be PFA (perfluoroalkoxy) layer having a thickness of 30 μm formed on the elastic layer, and the surface layer contacts a toner image. The cooling/separation belt 51 has a surface property having an arithmetic mean deviation of the profile Ra of 0.03 μm, for example.

The pressure roller 57 may include a metal core made of aluminum, and a silicone rubber layer having a thickness of 1 mm formed on the metal core, for example. The heat pipe 55 cools a toner image on the recording medium P in a short time period via the cooling/separation belt 51 after the recording medium P moves past the nip portion of the heat roller 52 and the pressure roller 57.

Such configured fixing unit 5 is operated as follows. The recording medium P having unfixed toner image is fed to the fixing unit 5 from the image forming engine 4 using the transport belt 3 in a direction shown by an arrow in FIG. 3. When the recording medium P comes to the nip portion, the heat roller 52 (having the heater 54) and the pressure roller 57 (having the heater 58) apply heat and pressure to the toner image to melt and fix the toner image on the recording medium P.

Then, the recording medium P is fed to the cooling/separation belt 51, and is transported along a traveling direction of the cooling/separation belt 51 while closely contacted on the cooling/separation belt 51. During such transportation, the heat pipe 55 cools the toner image on the recording medium P. Then, the recording medium P is separated from the cooling/separation belt 51 at a curvature of the separation roller 53, and then transported outside of the fixing unit 5. As such, the cooling/separation belt 51, the heat pipe 55, and the separation roller 53 function as a cooling and separation unit, in which the toner image fixed on the recording medium P is cooled and then separated from the cooling/separation belt 51. Hereinafter, the cooling/separation belt 51, the heat pipe 55, and the separation roller 53 may be collectively referred "cooling and separation unit 51/53/55."

When the toner image is cooled and then separated from the cooling/separation belt 51, a surface property such as surface roughness of the cooling/separation belt 51 can be transferred to the toner image formed on the recording medium P. In general, the cooling/separation belt 51 has a relatively smooth surface to reduce a possibility of hot offset. Accordingly, when the toner image is cooled and then separated from the cooling/separation belt 51, such toner image can be formed as an image having higher glossiness.

In an exemplary embodiment 1, the recording medium P was fed with a transport velocity (or linear velocity) of 50 mm/sec, for example, and a solid image on the recording medium P fed from the fixing unit 5 had a higher glossiness of about 80%, for example, which was observed by an experiment.

As illustrated in FIG. 3, the re-heating unit 6 includes a re-heat roller 61 as a contacting member, a pressure roller 63 for applying pressure to a toner image on the recording medium P, for example. The re-heat roller 61 and the pressure roller 63 have heaters 62 and 64 (as re-heat source), such as halogen heater, for example. The re-heating unit 6 re-heats the toner image on the recording medium P under a pressurized condition. Specifically, the pressure roller 63 contacts the re-heat roller 61 with a given pressure, and the recording medium P is passed through a nip formed between the pressure roller 63 and the re-heat roller 61.

The re-heat roller 61 may include a metal core made of aluminum, and a coating layer having a thickness of 100 μm formed on the metal core, for example. The coating layer may be PFA (perfluoroalkoxy) tube having a surface roughness of arithmetic mean deviation of the profile Ra of 0.25 μm, for example, wherein the coating layer may be finished by a polishing process. The pressure roller 63 may include a metal core made of aluminum, and a silicone rubber layer having a thickness of 1 mm formed on the metal core, for example.

Such configured re-heating unit 6 is operated as follows. The recording medium P having fixed toner image thereon is fed to a nip portion set between the re-heat roller 61 and the pressure roller 63. As above described, the toner image on the recording medium P, processed by the cooling and separation unit 51/53/55 of the fixing unit 5, has a higher glossiness. When the recording medium P comes to the nip portion in the re-heating unit 6, the re-heat roller 61 (having the heater 62) and the pressure roller 63 (having the heater 64) re-heat and soften the toner image.

During such re-heating process, a surface property (e.g., surface roughness) of the re-heat roller 61 (contacting member) can be transferred to the toner image, in which the re-heat roller 61 may have a relatively rough surface. Accordingly, a surface roughness of the toner image on the recording medium P becomes greater and closer to a surface property of (contacting member), by which a glossiness of the toner image on the recording medium P after passing through the re-heating unit 6 becomes lower than a glossiness of the toner image on the recording medium P before passing through the re-heating unit 6. In an exemplary embodiment, the recording medium P was fed with a transport velocity (or linear velocity) of 50 mm/sec, for example, in the re-heating unit 6, and glossiness of a solid image on the recording medium P ejected from the re-heating unit 6 was lowered to a glossiness value of about 40%, for example, which was observed by an experiment. Further, based on sensory evaluation in the experiment, it is confirmed that an image having a good level of glossiness can be output on a recording medium having a glossiness value of 20% to 50% using the re-heating unit 6.

Further, the fixing unit 5 and the re-heating unit 6 can be configured to other configuration within a spirit of the present invention. Specifically, the fixing unit 5 can be configured to other configuration if the image glossiness can be set relatively higher level such as 60-degree specular glossiness value of 40% or more. Further, the cooling/separation belt 51 or the like can be configured to other configuration. Further, the re-heating unit 6 can be configured to other configuration if such configuration can decrease glossiness of a toner image on the recording medium P after re-heating compared to before re-heating. Further, the re-heat roller 61 can take surface roughness of given value for arithmetic mean deviation of the profile Ra other than 0.25 μm. In view of setting glossiness of toner image after re-heating (after modifying surface property) to 10% to 60%, the re-heat roller 61 preferably has arithmetic mean deviation of the profile Ra from 0.001 μm (1 nm) to 10 μm for its surface.

A description is now given to an experiment for verifying the aforementioned effect with reference to FIG. 5. In the experiment, image forming apparatuses of Example 1 and Comparative Example 1 to 3 were used to form a toner image on recording media having six different glossiness to evaluate graininess and evenness of glossiness of output image. A description is now given to experiment conditions.

EXAMPLE 1

Example 1 uses an image forming apparatus 1 having the fixing unit 5 and the re-heating unit 6 according to an exemplary embodiment. The cooling/separation belt 51 had a surface roughness of arithmetic mean deviation of the profile Ra of 0.03 μm.

COMPARATIVE EXAMPLE 1

Figure 4:
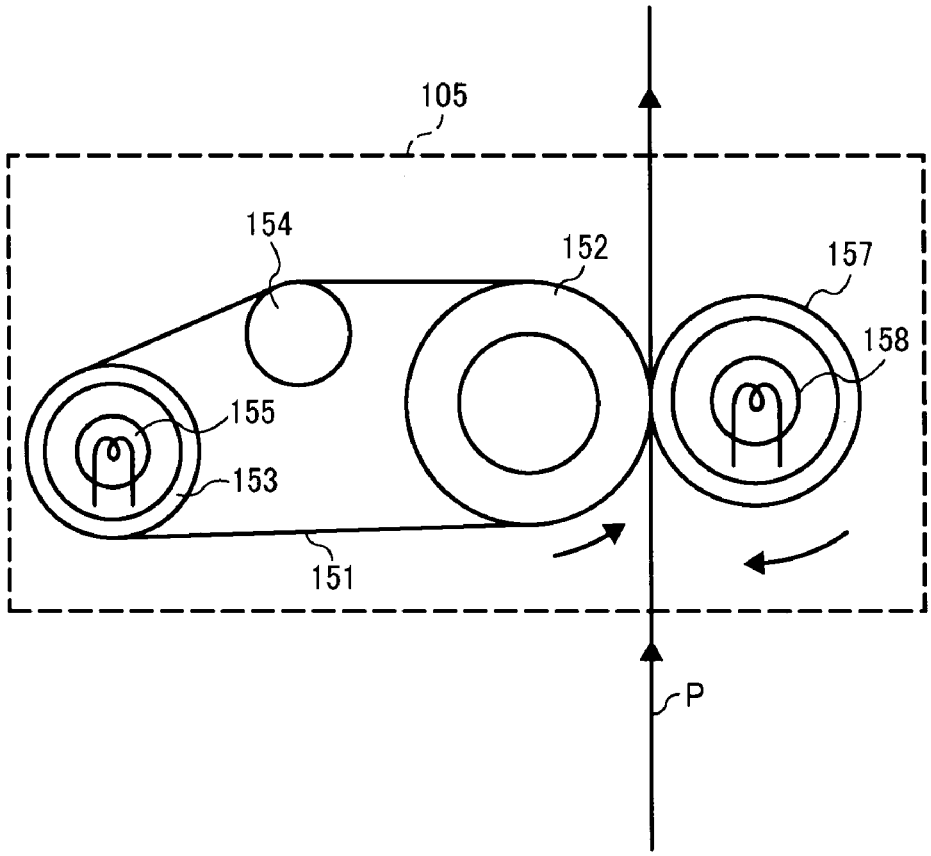
FIG. 4 illustrates a schematic configuration of a conventional fixing unit.

Comparative Example 1 uses an image forming apparatus having a fixing unit 105, which is a conventional fixing unit using belt-fixing as illustrated in FIG. 4. The fixing unit 105 includes a fixing belt 151, a sponge roller 152, a heat roller 153, a tension roller 154, and a pressure roller 157, for example. The fixing belt 151 is extended by the rollers 152 to 154. The heat roller 153 has a heater 155 therein. The sponge roller 152 is pressed against the pressure roller 157 via the fixing belt 151 to form a nip portion. The pressure roller 157 has a heater 158 therein. The fixing belt 151 includes a base layer, an elastic layer, and a surface layer. The base layer was made of polyimide film. The elastic layer, made of silicone rubber having a thickness of 200 μm, was formed on the base layer. The surface layer, made of PFA layer, was formed on the elastic layer. Further, the sponge roller 152 includes a metal core, and an elastic layer, made of foamed silicone having a thickness of 10 mm and formed on the metal core.

COMPARATIVE EXAMPLE 2

Comparative Example 2 uses the image forming apparatus 1, in which the re-heating unit 6 is removed, but other configurations are same as the image forming apparatus 1 used for Example 1. As similar to Example 1, the cooling/separation belt 51 had a surface roughness of arithmetic mean deviation of the profile Ra of 0.03 μm.

COMPARATIVE EXAMPLE 3

Comparative Example 3 uses an image forming apparatus having a configuration similar to the image forming apparatus used in Comparative Example 2 except the cooling/separation belt 51 has a more roughened surface compared to Example 2. The cooling/separation belt 51 had a surface roughness of arithmetic mean deviation of the profile Ra of 0.25 μm.

As shown in FIG. 5, six different types of recording media, manufactured by three manufacturers, were used for the experiment, wherein the each type has different glossiness value for 60-degree specular glossiness. Toner image formed on the recording medium P includes a white area (exposed surface of the recording medium P), a high concentration area (dark area), and a middle-range concentration area, wherein an original image was a photograph. "Evenness of glossiness" of image was evaluated by eye observation (visual observation) whether the glossiness of toner image formed on the recording medium has a sense of discomfort. FIG. 5 shows experiment result of the glossiness of toner image, in which "○" indicates that no sense of discomfort is observed on glossiness, "Δ" indicates that some sense of discomfort is observed on glossiness, and "X" indicates that strong sense of discomfort is observed on glossiness.

"Graininess" of image was also evaluated by eye observation (visual observation) whether the graininess of image formed on the recording medium causes a sense of discomfort. FIG. 5 shows experiment result of the graininess of toner image, in which "○" indicates that no graininess is observed, which means image has good quality, "Δ" indicates that graininess is observed but not having a sense of discomfort, which means image has acceptable quality, and "X" indicates that graininess is observed strongly, which means image quality is not acceptable.

As shown in FIG. 5, Example 1 has a good level of graininess and evenness of glossiness for images formed on a recording medium having middle glossiness such as OK Kasao, OK Casablanca, OK Casablanca-X, (available from OJI Paper Co.), and FC art paper (available from NBS Ricoh).

Comparative Example 1 has a good level of graininess and evenness of glossiness for images formed on a plain paper having lower glossiness such as color PPC sheet "type 6000 70W" (available from Ricoh Company, Ltd.). However, Comparative Example 1 has no good level of evenness of glossiness for images formed on a recording medium having middle to higher glossiness.

Comparative Example 2 has a good level of graininess and evenness of glossiness for images formed on a recording medium having higher glossiness such as FC glossiness paper (available from NBS Ricoh). However, Comparative Example 2 has no good level of evenness of glossiness for images formed on a recording medium having lower to middle glossiness.

Comparative Example 3 has a good level of evenness of glossiness for images formed on a recording medium having middle glossiness. However, Comparative Example 3 has no good level of graininess because the cooling/separation belt 51 has a greater surface roughness.

Based on the experiment results, it was confirmed that an image forming apparatus according to an exemplary embodiment can maintain a good level of graininess and evenness of glossiness for images formed on recording media having different glossiness, especially for recording medium having middle glossiness such as 60-degree specular glossiness value is 10% to 60%.

Further, by reviewing the experiment results of Example 1, Comparative Examples 1 and 2 overall, it was confirmed that an image forming apparatus according to an exemplary embodiment can maintain a good level of graininess and evenness of glossiness for images formed on a recording medium having lower glossiness such as 60-degree specular glossiness value of 5% or less by not conducting a cooling/separation process by the cooling and separation unit 51/53/55. Although not shown, the cooling/separation belt 51 and the heat pipe 55 can be detached from a transport route of the recording medium P by a separation unit so as not to cool the recording medium P having a toner image, fed from the nip portion of the fixing unit 5.

Further, when a recording medium having higher glossiness (60-degree specular glossiness value is 80% to 100%) is used, it was confirmed that an image forming apparatus according to an exemplary embodiment can maintain a good level of graininess and evenness of glossiness for images formed on a recording medium having higher glossiness by not conducting re-heating (or surface property modification) by the re-heating unit 6. Although not shown, by detaching the re-heat roller 61 from the pressure roller 63 by using a separation unit, and stopping a power supply to the heaters 62 and 64, a toner image on the recording medium fed to the re-heating unit 6 is not re-heated (or not to be subjected to surface property modification) in the re-heating unit 6.

A description is now given to effects of an image forming apparatus according to an exemplary embodiment. Specifically, a description is given to the effect of the fixing unit 5 and the re-heating unit 6, which can decrease glossiness of toner image after re-heating compared to before re-heating, wherein the toner image is fixed on the recording medium P by the fixing unit 5.

In a conventional method using a fixing unit and a re-heating unit, glossiness of toner image is increased from lower glossiness to middle or higher level glossiness when to change glossiness of the toner image after the toner image is fixed by the fixing unit as a lower glossiness image.

On one hand, in an exemplary embodiment, glossiness of toner image is adjusted to higher glossiness by the cooling and separation unit 51/53/55, and then the glossiness of toner image is decreased to middle or lower level glossiness by using the re-heating unit 6. With such glossiness controlling, degradation of graininess of an output image can be effectively suppressed. Accordingly, a higher quality image having a good level of graininess and middle or lower level glossiness can be output.

By forming an image having higher glossiness and then decreasing glossiness of the image to middle level glossiness, graininess of the image can be enhanced. Although the reason for such graininess enhancement is not fully known yet, the reason may be that toner on the recording medium P may be less likely to be transferred to the re-heat roller 61 when the re-heating unit 6 modifies surface property of the toner image.

In the fixing unit 5, a toner image is fixed on the recording medium P, and then the cooling/separation belt 51 is contacted against the toner image formed on the contacting member to cool the toner image. During such cooling process, some portion of the toner image may be transferred to the cooling/separation belt 51, used as a contacting member. Such toner-transfer phenomenon may more likely occur when the toner image glossiness is controlled to middle to lower glossiness, and such transfer phenomenon may less likely occur when the toner image glossiness is controlled to higher glossiness, which may be used for producing photographic quality image with a conventional technique.

If the toner image glossiness is controlled to middle to lower glossiness by contacting the cooling/separation belt 51 against the toner image fixed on recording medium P after the fixing process in the fixing unit 5, the cooling/separation belt 51 may need to have a surface having a relatively greater surface irregularity. However, if the cooling/separation belt 51 has greater surface irregularity, the toner image and the cooling/separation belt 51 may be attracted each other with greater adhesive force, and thereby a relatively greater amount of toner may be transferred to the cooling/separation belt 51 when the toner image is separated from the cooling/separation belt 51, which is not preferable. On one hand, if the cooling/separation belt 51 has smaller surface irregularity, the toner image and the cooling/separation belt 51 may be attracted each other with smaller adhesive force, and thereby an amount of toner, which may be transferred to the cooling/separation belt 51, can be reduced.

As indicated by the experiment results shown in FIG. 5, the configuration of the image forming apparatus according to an exemplary embodiment can effectively reduce such toner-transfer phenomenon because toner image glossiness can be firstly controlled to higher glossiness in the fixing unit 5 and then controlled to lower glossiness by the re-heat roller 61 in the re-heating unit 6. With such configuration, degradation of graininess of toner image formed on the recording medium P can be effectively reduced or prevented.

A description is given to the effect of re-heating toner image on the recording medium P under a pressurized condition by the re-heating unit 6. By applying heat to the toner image while pressing the recording medium P using the re-heat roller 61, a surface of the toner image can be softened, by which surface roughness of the re-heat roller 61 can be transferred to the toner image. Accordingly, surface roughness of the toner image and surface roughness of the re-heat roller 61 can be substantially matched. Accordingly, glossiness of output image can be maintained at a given level without strict temperature control for the re-heating unit 6, and without strict time control of sheet passing time of the recording medium P in the re-heating unit 6.

A description is given to the effect of the cooling and separation unit 51/53/55 of the fixing unit 5, used for cooling and separating a toner image after a fixing process.

As above described, the re-heating unit 6 modifies a glossiness of toner image from higher glossiness to lower glossiness. Accordingly, a toner image having higher glossiness needs to be formed by the fixing unit 5, which is disposed upstream side of the re-heating unit 6. By forming a toner image having higher glossiness at the fixing unit 5, a glossiness range of toner image after passing through the re-heating unit 6 can be set to greater range. Accordingly, glossiness of toner image formed on recording media having higher to middle glossiness can be optimized in an exemplary embodiment. In an exemplary embodiment, a toner image having higher glossiness (60-degree specular glossiness value is 80% or more) can be formed by using the cooling and separation method right after a fixing process.

Further, the cooling and separation unit 51/53/55 is preferably disposed in the fixing unit 5 from a viewpoint of reducing restriction on toner property. If a conventional fixing unit having no cooling and separation unit is used for forming a toner image having higher glossiness, restriction on toner property may become sever. Specifically, wax-included toner may not be used for forming a toner image having higher glossiness. Although the reason for such glossiness issue for wax-included toner is not fully known yet, the reason may be that wax-included toner particles do not effectively melt each other because wax, which can reduce adhesiveness of toner image to a fixing device (e.g, fixing roller), may also reduce adhesiveness of toner particles each other. If toner particles may not effectively melt each other, a tone image may have some space between the toner particles, by which a toner image having higher glossiness may not be formed, and a toner image of wax-included toner may be formed as an image having a relatively lower glossiness. It should be noted that, as above mentioned, the reason for such glossiness issue for wax-included toner is not fully known yet.

Further, the cooling and separation unit 51/53/55 is preferably disposed in the fixing unit 5 from a viewpoint of maintaining relatively higher glossiness for output image. Specifically, such cooling and separation unit 51/53/55 can be used to reduce a phenomenon that an image-formed area having middle-range concentration becomes lower glossiness, wherein the middle-range concentration image means an image having a toner-adhered area and a toner-not-adhered area.

In case of using a conventional fixing unit having no cooling and separation unit, a solid image having higher glossiness can be formed reliably. However, as for a toner image of middle-range concentration composed of toner-adhered area and toner-not-adhered area, the toner image may not be pressed smoothly by the conventional fixing unit, by which glossiness of the image may become lower. For example, a toner image of middle-range concentration formed on a sheet having a smooth surface, such as coated sheet, may not be pressed smoothly on the sheet by the conventional fixing unit, in which a height of toner image from a surface of the sheet may be 5 μm and the sheet may have a surface roughness of 1 μm, for example.

As above described, an image forming apparatus according to an exemplary embodiment 1 can decrease glossiness of toner image after re-heating compared to glossiness of toner image before re-heating, wherein such toner image is already fixed on the recording medium P by applying heat in the fixing unit 5. With such configuration, graininess of toner image formed on recording media having different glossiness can be set to a given preferable level and evenness of glossiness of image can be set to a given preferable level.

Figure 6:
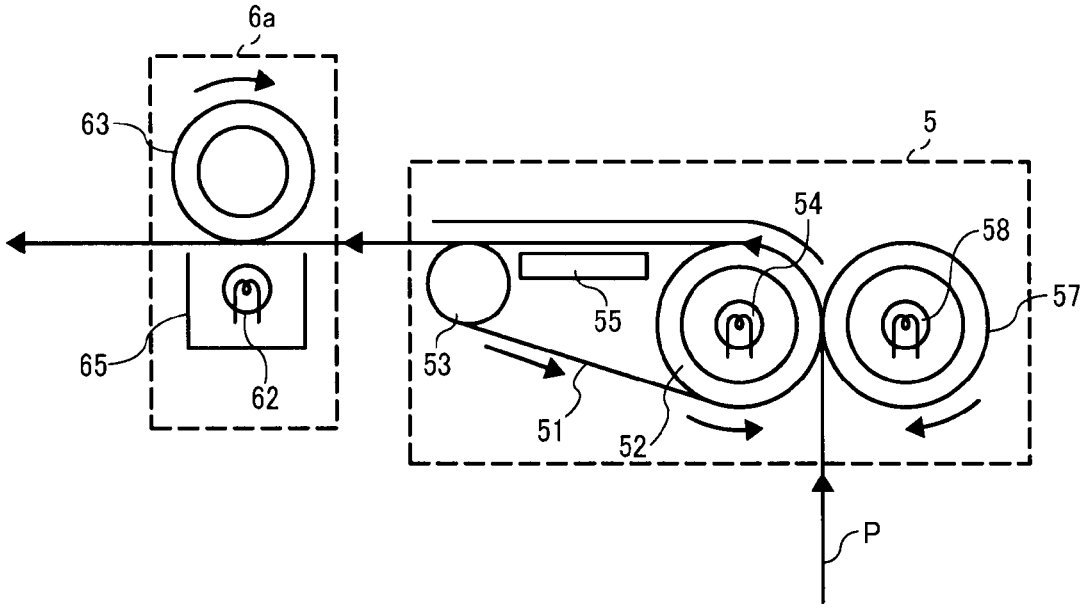
FIGS. 6 to 8 illustrates schematic configurations of fixing units and re-heating units according to another exemplary embodiments.

A description is now given to a second exemplary embodiment with reference to FIG. 6. FIG. 6 illustrates a schematic view of a fixing unit and a re-heating unit according to the second exemplary embodiment. The re-heating unit shown in FIG. 6 has a configuration, which is different from a configuration according to the first exemplary embodiment shown in FIG. 3.

As illustrated in FIG. 6, an image forming apparatus of the second exemplary embodiment includes the fixing unit 5 and a re-heating unit **6*a* as similar to the first exemplary embodiment shown in FIG. 3. However, different from the re-heating unit 6 shown in FIG. 3, the re-heating unit 6*a*** re-heats a toner image on the recording medium P without contacting a heat applying member to a toner image.

Specifically, the re-heating unit **6*a* includes a re-heat plate 65, and the pressure roller 63, for example. The re-heat plate 65 has a heater 62 therein, and the pressure roller 63 contacts a back face of the recording medium P having no toner image. The re-heat plate 65, disposed at a given position to face a toner image on the recording medium P, applies heat to the toner image to change surface property, such as glossiness, of the toner image when the recording medium P is transported in the re-heating unit 6*a*. The re-heat plate 65 and the heater 62 apply a given heat energy to set a given temperature at the recording medium P. For example, the temperature at the recording medium P is set to about 110 degrees Celsius. Further, the re-heat plate 65 is preferably used as a reflector to enhance heating efficiency of the heater 62 to the toner image. Further, the pressure roller 63** does not include a heater therein, and functions as a transport roller for transporting the recording medium P.

In the second exemplary embodiment shown in FIG. 6, the re-heating unit **6*a* applies heat to a toner image without contacting a heat applying member to the toner image, which is different from the re-heating unit 6 shown in FIG. 3. Such re-heating unit 6*a* can also be used to effectively decrease glossiness of a toner image having higher glossiness, adjusted by the cooling and separation unit 51/53/55 of the fixing unit 5, by re-heating the toner image. In the second exemplary embodiment, the recording medium P is transported at a transport velocity (linear velocity) of 50 mm/sec, for example, in the re-heating unit 6*a*, and glossiness of a solid image on the recording medium P ejected from the re-heating unit 6*a*** was lowered to a glossiness value of about 40%, for example, which was observed by experiment.

As above described, in the second exemplary embodiment, glossiness of a toner image can be decreased and surface property of toner image can be modified without contacting a heat applying member to a toner image. Accordingly, the re-heating unit 6*a* can be configured with a simple configuration.

Further, the configuration shown in FIG. 6 can be preferably used for forming higher quality image on both faces of a recording medium when a double face printing is conducted. The re-heating unit 6*a* can effectively re-heat one face of the recording medium P, facing the heater 62, by which other face of the recording medium P that is an opposite face of the one face may not be heated so much (i.e., heat energy of the heater 62 may not reach the other face so much). During a double face printing process, a first image is fixed on a first face of the recording medium P and then the first image is processed by the re-heating unit 6*a*, and then the recording medium P is inverted by a sheet-face inverting unit so that a second image can be fixed on a second face of the recording medium P, in which the second face is an opposite face of the first face. Then, the second image is also processed by the re-heating unit 6*a*. When the heater 62 heats the second image on the second face, heat energy of the heater 62 may not reach the first image on the first face so much because the first face does not face the heater 62. Accordingly, when the second image is adjusted to a suitable glossiness in the re-heating unit 6*a*, an effect of the heat energy of the heater 62 to the first face already having an adjusted glossiness can be effectively reduced, by which surface property of the first image on the first face may be maintained at a preferable condition. Accordingly, higher quality image can be formed on both faces of the recording medium P.

As above described, an image forming apparatus according to an exemplary embodiment 2 can decrease glossiness of toner image after re-heating compared to glossiness of toner image before re-heating, wherein such toner image is already fixed on the recording medium P by applying heat in the fixing unit 5. With such configuration, graininess of toner image formed on recording media having different glossiness can be set to a given preferable level and evenness of glossiness of image can be set to a given preferable level.

Figure 7:
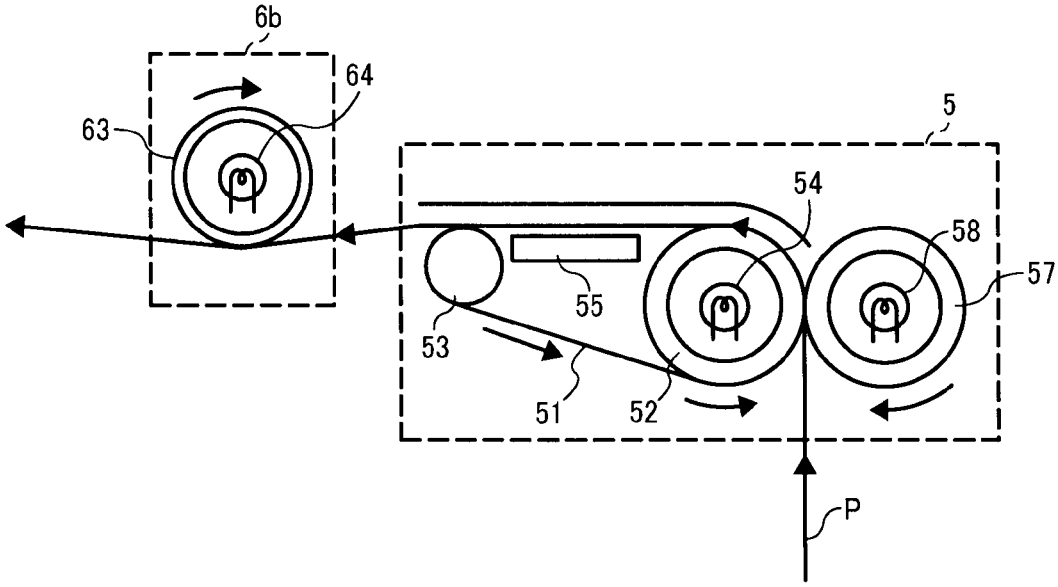

A description is now given to a third exemplary embodiment with reference to FIG. 7. FIG. 7 illustrates a schematic view of a fixing unit and a re-heating unit according to the third exemplary embodiment. The re-heating unit shown in FIG. 7 has a configuration, which is different from a configuration shown in FIG. 3.

As illustrated in FIG. 7, an image forming apparatus in the third exemplary embodiment includes the fixing unit 5 and a re-heating unit 6*b* as similar to the above described exemplary embodiments. However, different from the above described exemplary embodiments, the re-heating unit 6*b* indirectly re-heats a toner image on the recording medium P without contacting a heat applying member to a toner image.

Specifically, the re-heating unit 6*b* includes the pressure roller 63, for example. The pressure roller 63 contacts a back face of the recording medium P having no toner image. The pressure roller 63 has the heater 64 therein. With such configuration, the pressure roller 63 indirectly re-heats toner image on the recording medium P from a back face of the recording medium P.

Accordingly, heat energy of the pressure roller 63 reaches the toner image via the recording medium P. The pressure roller 63 and the heater 64 apply a given heat energy to set a given temperature at the recording medium P. For example, the temperature at the recording medium P is set to about 140 degrees Celsius.

In the third exemplary embodiment, the re-heating unit 6*b* applies heat to a toner image without contacting a heat applying member to the toner image but indirectly re-heats the toner image via the recording medium P, which is different from the re-heating unit 6 shown in FIG. 3. Such re-heating unit 6*b* can also be used to effectively decrease glossiness of a toner image having higher glossiness, adjusted by the cooling and separation unit 51/53/55 of the fixing unit 5, by re-heating the toner image. In the third exemplary embodiment, the recording medium P is transported at a transport velocity (linear velocity) of 50 mm/sec, for example, in the re-heating unit 6*b*, and glossiness of a solid image on the recording medium P ejected from the re-heating unit 6*a* was lowered to a glossiness value of about 40%, for example, which was observed by experiment.

As above described, an image forming apparatus according to the third exemplary embodiment can decrease glossiness of toner image after re-heating compared to glossiness of toner image before re-heating, wherein such toner image is already fixed on the recording medium P by applying heat in the fixing unit 5.

With such configuration, graininess of toner image formed on recording media having different glossiness can be set to a given preferable level and evenness of glossiness of image can be set to a given preferable level.

Figure 8:
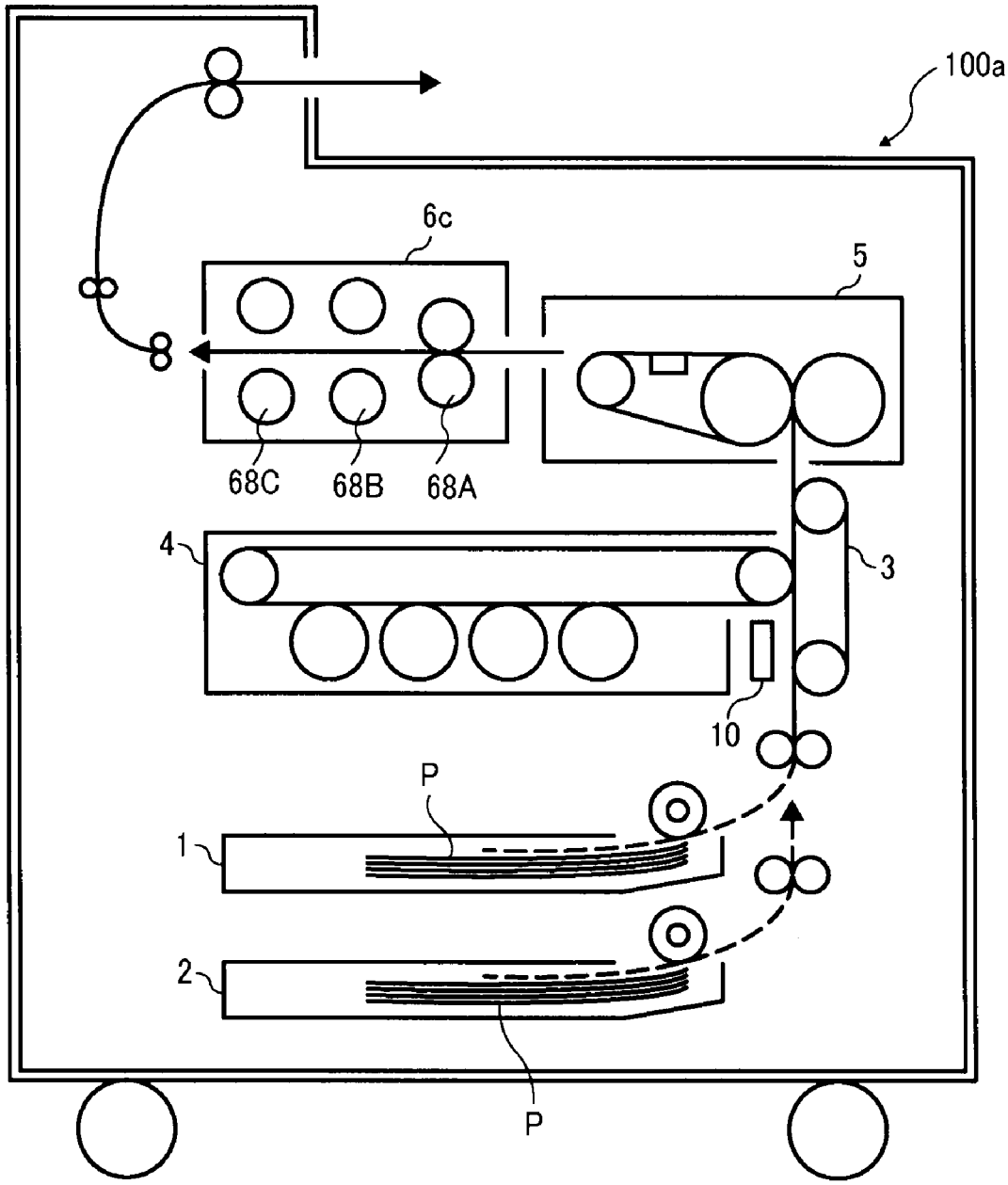

A description is now given to a fourth exemplary embodiment with reference to FIGS. 8 to 11. FIG. 8 illustrates a configuration of an image forming apparatus 100*a* according to the fourth exemplary embodiment. The image forming apparatus 100*a* has a configuration, which is different from a configuration of the image forming apparatus 100 shown in FIG. 1. Specifically, the image forming apparatus 100*a* is disposed with a plurality of re-heating devices in a re-heating unit, which is different from the above-described embodiments.

As illustrated in FIG. 8, the image forming apparatus 100*a* includes the fixing unit 5 and a re-heating unit 6*c*. The re-heating unit 6*c* includes re-heating devices 68A to 68C to change a decreasing level of glossiness of a toner image formed on the recording medium P. A user can select any one of the re-heating devices 68A to 68C by operating an operation unit of the image forming apparatus 100*a*.

Each of the re-heating devices 68A to 68C includes the heat roller 61, the pressure roller 63, or the like as similar to other exemplary embodiments. Further, a heat roller and a pressure roller used for the re-heating devices 68A to 68C can be set to a contacted state or a discontacted state. Specifically, by selecting any one of the re-heating devices 68A to 68C, the heat roller and the pressure roller of the selected re-heating device can be set to a contacted state. FIG. 8 shows a state that the first re-heating device 68A is selected.

Further, the heat rollers of the re-heating devices 68A to 68C, which contact a toner image on the recording medium P, may have different surface roughness. For example, the heat roller of the first re-heating device 68A has a surface roughness of arithmetic mean deviation of the profile Ra of 0.10 μm, the heat roller of the second re-heating device 68B has a surface roughness of arithmetic mean deviation of the profile Ra of 0.30 μm, and the heat roller of the third re-heating device 68C has a surface roughness of arithmetic mean deviation of the profile Ra of 0.50 μm.

By selecting any one of the re-heating devices 68A to 68C, a decreasing level of glossiness of toner image formed on the recording medium P can be changed. Because a toner image can be transferred with a surface roughness of heat rollers having different surface property, glossiness of toner image can be controlled to a plurality of levels. For example, the glossiness value of toner image at 60-degree specular glossiness becomes about 50% when the first re-heating device 68A is selected, about 30% when the second re-heating device 68B is selected, and about 15% when the third re-heating device 68C is selected.

Figure 9:
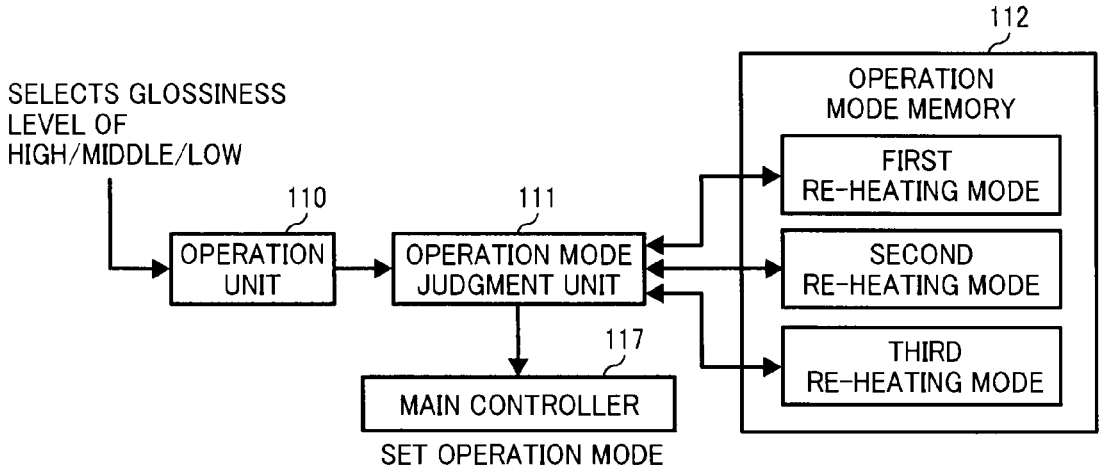
FIG. 9 shows a block diagram for selecting image forming modes for the image forming apparatus of FIG. 8.

FIG. 9 illustrates a block diagram of mode selection for the re-heating devices 68A to 68C to be conducted in the image forming apparatus 100*a*.

A user can select glossiness level of high/middle/low using an operation unit 110. Based on the selection, an operation mode judgment unit 111 reads any one of first to third re-heating modes stored in an operation mode memory 112, and set a given operation mode to a main controller 117. The first to third re-heating modes may be corresponded to the re-heating devices 68A to 68C, and includes different conditions such as contact/discontact of heat roller and pressure roller, transport velocity of recording medium and the like.

With such configuration, an image can be output on recording media having various glossiness by selecting a glossiness level, which is suitable to a recording medium, from a plurality of glossiness level, by which a higher quality image having good level of evenness of glossiness can be obtained. Accordingly, one image forming apparatus alone can output an image having optimal glossiness on various recording media used by a user, such as recording media having lower, middle, and higher glossiness. Accordingly, images having optimal glossiness can be output without replacing parts or units of an image forming apparatus by a user or service person, by which usability of image forming apparatus can be enhanced.

Most of users may have similar preference on each specific type of recording medium, in which such preference may be within a given range of glossiness, wherein such given range of glossiness may be about ±10%, for example. However, each user may have different preference on glossiness within such ±10% range, for example. By using a configuration of the image forming apparatus 100*a* shown in FIG. 8, glossiness of image can be changed by a user selection, by which images having glossiness matched to a user preference can be output.

Figure 10:
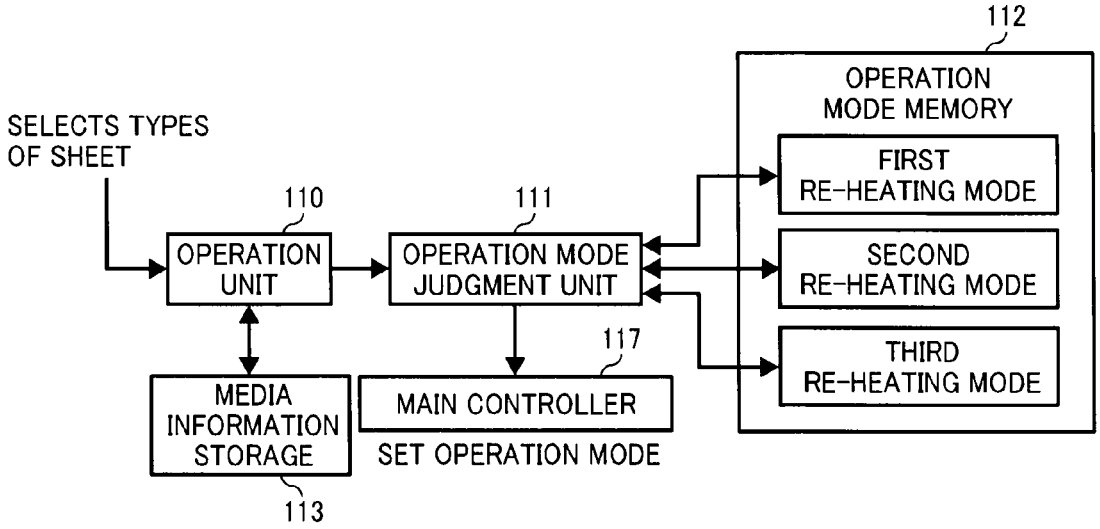
FIG. 10 shows another block diagram for selecting image forming modes for the image forming apparatus of FIG. 8.

In the fourth exemplary embodiment, a user can select any one of the re-heating devices 68A to 68C by operating the operation unit 110 of the image forming apparatus 100*a*. FIG. 10 illustrates a block diagram for mode selection of the re-heating devices 68A to 68C to be conducted in the image forming apparatus 100*a*. When a user selects types of recording media using the operation unit 110, media information (e.g., glossiness information) is read from a media information storage 113, and then transmitted to the operation mode judgment unit 111. The operation mode judgment unit 111 reads any one of first to third re-heating modes stored in a operation mode memory 112 based on the media information, and set a given operation mode to the main controller 117. Because glossiness of image is dependent to glossiness of recording medium, it is useful to adjust image glossiness of image for each type of recording medium having a specific glossiness.

Figure 11:
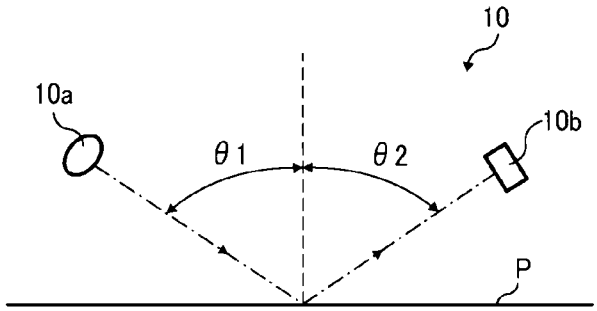
FIG. 11 illustrates a schematic configuration of a glossiness sensor.

Alternatively, any one of the re-heating devices 68A to 68C can be automatically selected by detecting types of recording media using a detector, in which a user does not need to select types of recording media. The detector may be a glossiness detector, which detects glossiness of recording media. Specifically, as illustrated in FIG. 8, a glossiness sensor 10 can be disposed along a transport route of the recording medium P, which is a downstream side of the sheet cassettes 1 and 2. The glossiness sensor 10 optically detects glossiness of the recording medium P in the transport route before a toner image is transferred to the recording medium P. As illustrated in FIG. 11, the glossiness sensor 10 includes a light emitting device 10*a*, and a light receiving device 10*b*. The light emitting device 10*a* may be a tungsten filament lamp, and the light receiving device 10*b* may be a photodiode element, for example. For example, the light emitting device 10*a* emits a light beam to the recording medium P with an incoming radiation angle θ1 of 60 degrees on the recording medium P, and the light receiving device 10*b* receives a reflection light, regularly reflected on the recording medium P with an outgoing radiation angle θ2 of 60 degrees. The glossiness of the recording medium P is determined by measuring intensity of the reflection light as 60-degree specular glossiness value.

Because glossiness of image is dependent to glossiness of recording medium, it is useful to adjust image glossiness of image for each type of recording medium having a specific glossiness. Such automatic detection system for detecting glossiness of the recording medium P using the glossiness sensor 10 may be preferable from a viewpoint of usability. If a user may use many types of recording media, the user may feel inconvenience to input glossiness information of each of recording media. Accordingly, such automatic detection system can reduce such inconvenient situation.

As above described, the image forming apparatus 100*a* according to the fourth exemplary embodiment can decrease glossiness of toner image after re-heating compared to glossiness of toner image before re-heating, wherein such toner image is already fixed on the recording medium P by applying heat in the fixing unit 5.

With such configuration, graininess of toner image formed on recording media having different glossiness can be set to a given preferable level and evenness of glossiness of image can be set to a given preferable level.

Figure 12:
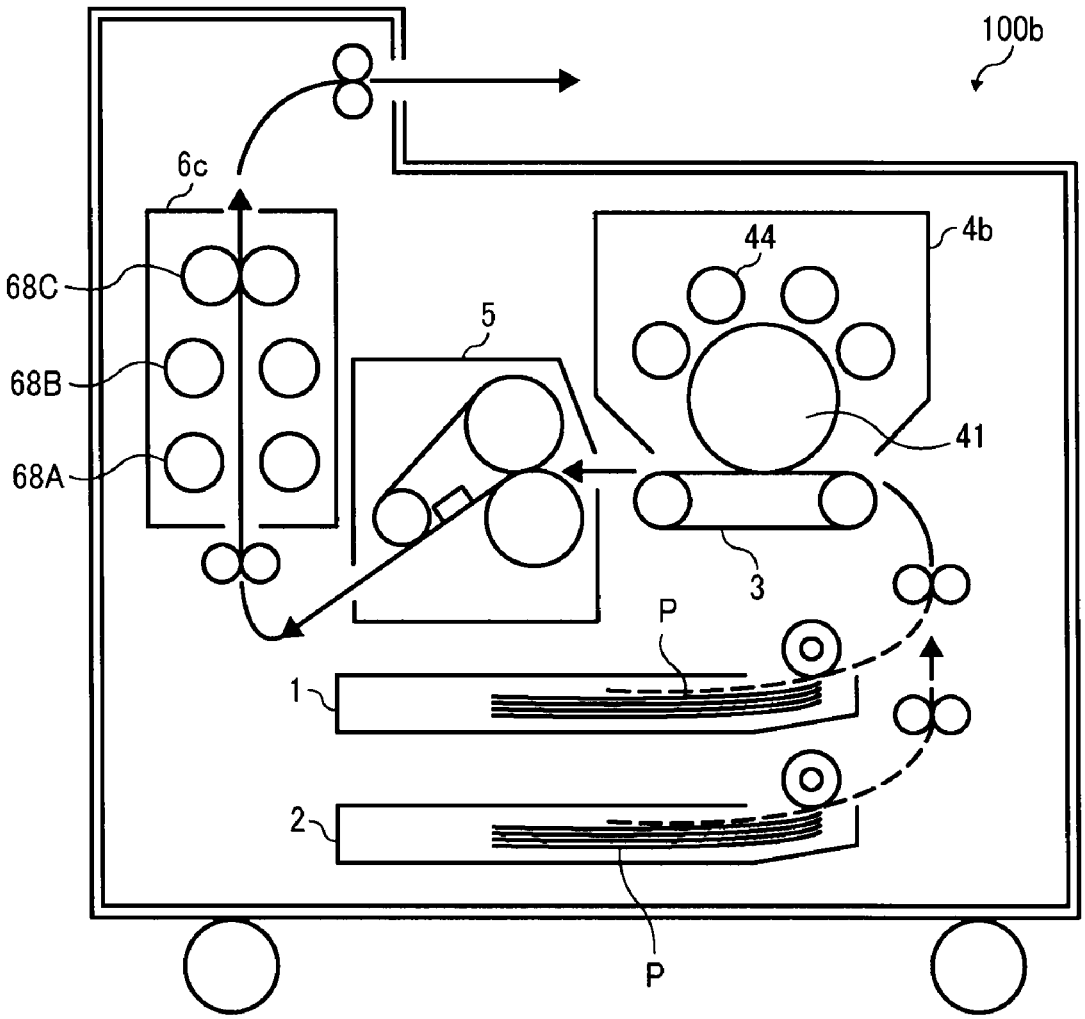
FIG. 12 illustrates a schematic configuration of an image forming apparatus having a fixing unit and a re-heating unit according to another exemplary embodiment.
Figure 13:
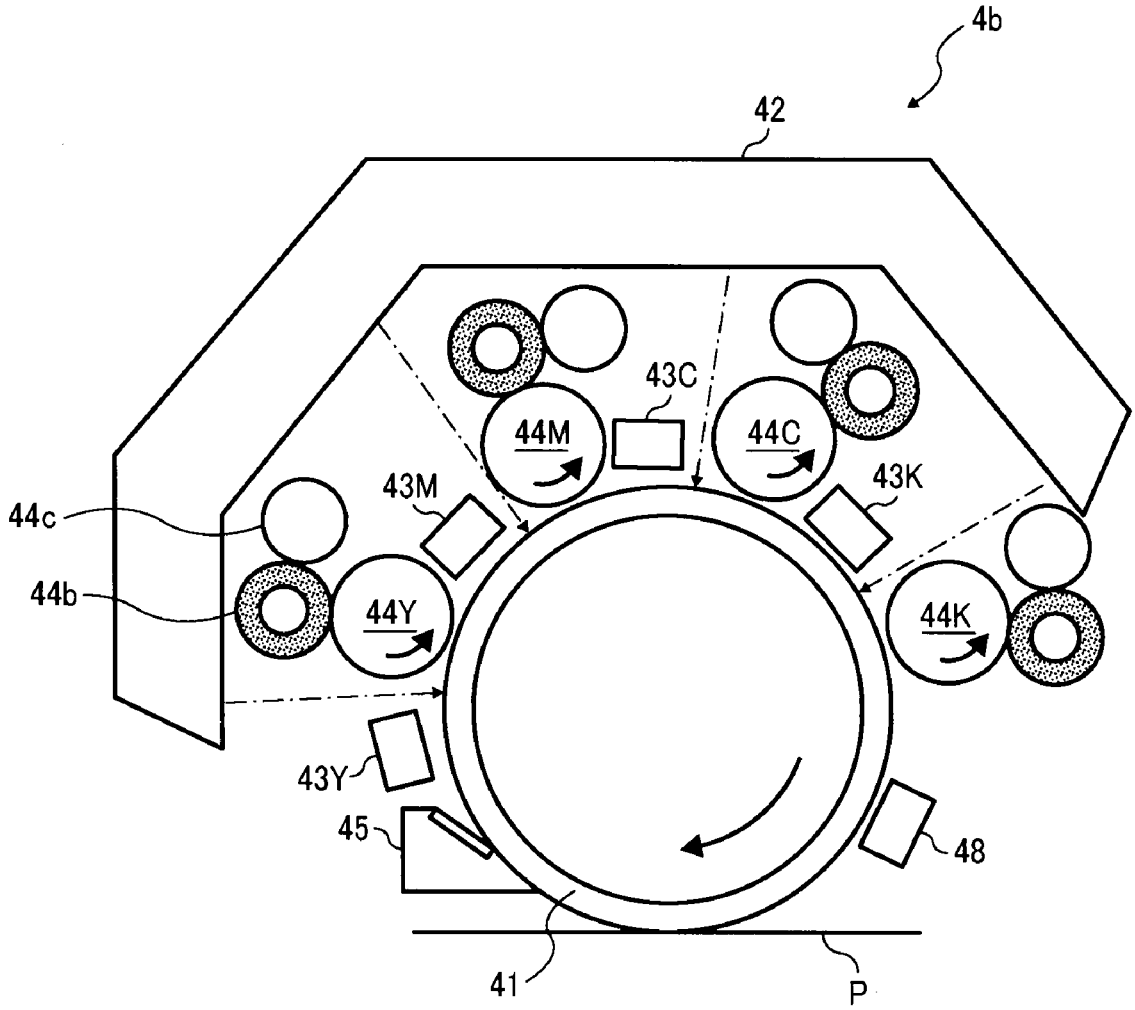
FIG. 13 illustrates a schematic configuration an image forming engine used in the image forming apparatus of FIG. 12.

A description is now given to a fifth exemplary embodiment with reference to FIGS. 12 and 13. FIG. 12 illustrates a schematic configuration of an image forming apparatus 100*b* according to the fifth exemplary embodiment, and FIG. 13 illustrates an expanded view of an image forming engine disposed in the image forming apparatus 100*b*. The image forming apparatus 100*b* has a configuration which is different from a configuration of the image forming apparatus 100 shown in FIG. 1. Specifically, the image forming apparatus 100*b* is disposed with an image forming engine 4*b*, which is different from the image forming apparatus 100.

The image forming engine 4*b* includes a photoconductor drum 41, and a transport belt 3, for example. The photoconductor drum 41, which is used as an image carrying member, carries a plurality of color toner images developed on the photoconductor drum 41. Accordingly, color toner images of CMYK are superimposed on the photoconductor drum 41. The transport belt 3 (or transfer/transport belt), used as a transport device, transports the recording medium P that receives the plurality of color toner images from the photoconductor drum 41.

A description is now given to an operation of the image forming apparatus 100*b*. The recording medium P ejected from the sheet cassette 1 is transported along a transport route to the transport belt 3. The transport belt 3 carries and transports the recording medium P on its surface. In the image forming engine 4*b*, toner images of yellow (Y), cyan (C), magenta (M), and black (K) are superimposed on the photoconductor drum 41, and then transferred to the recording medium P transported by the transport belt 3. The recording medium P is further transported to the fixing unit 5 by the transport belt 3. The fixing unit 5 applies heat and pressure to the recording medium P to fix the toner image on the recording medium P. As similar to the above-described embodiments, the toner image on the recording medium P is cooled and separated in the fixing unit 5 after a fixing process.

The recording medium P is then transported in a downward direction and upward direction (see FIG. 12) to feed the recording medium P to a re-heating unit 6*c*. As similar to the above described embodiments, the re-heating unit 6*c* re-heats the toner image on the recording medium P, fixed by the fixing unit 5, to decrease glossiness of the toner image after re-heating compared to before re-heating. Accordingly, the re-heating unit 6*c* functions as a surface property modification unit for modifying surface property of output image. Accordingly, an image having good level of evenness of glossiness can be output. Then the recording medium P is transported to an upper part of the image forming apparatus 100*b*, and ejected from the image forming apparatus 100*b*.

The image forming engine 4*b* can employ known configuration for superimposing a plurality of colors on a photoconductor. Such image forming engine 4*b* uses only one photoconductor drum, which is different from other configurations using four photoconductor drums arranged in tandem, and further can omit an intermediate transfer device, such as an intermediate transfer belt 47. Accordingly, the image forming engine 4*b* can preferably reduce its size.

As illustrated in FIG. 12, by using the image forming engine 4*b* having smaller size, the image forming apparatus 100*b* can allocate some space on a left side of the image forming engine 4*b*. In the fifth exemplary embodiment, the fixing unit 5 and the re-heating unit 6*c* are disposed in such space. With such configuration, the image forming apparatus 100*b* can reduce its size.

In general, a conventional image forming apparatus having no re-heating unit 6 and used for producing images on A3 size sheet may have some difficulty to reduce the size of the image forming apparatus just by reducing the size of the image forming engine. Because such image forming apparatus needs a tray for A3 size sheet, an occupying space of image forming apparatus can not be effectively reduced just by reducing the size of the image forming engine when the image forming apparatus is viewed from the above. Accordingly, even if the small sized image forming engine 4*b* having one photoconductor is employed, such saved space may not effectively reduce a size of image forming apparatus using A3 size sheer as a recording medium. In such a case, the saved space is not effectively used.

On one hand, in the fifth exemplary embodiment, the image forming apparatus 100*b* includes the re-heating unit 6*c*. Accordingly, a space allocated by reducing the size of the image forming engine 4*b* can be effectively used for disposing the re-heating unit 6*c*, by which an image forming apparatus using A3 size sheer as a recording medium can reduce its size effectively.

As illustrated in FIG. 13, the image forming engine 4*b* includes development units for each of YMCK color around the photoconductor drum 41. Each of the development units includes a developing roller 44 (44Y, 44C, 44M, and 44K) facing the photoconductor drum 41, a toner supply roller 44*b* for supplying toner to the developing roller 44, and a toner transport roller 44*c* for transporting toner in the development unit.

Charging devices 43Y, 43C, 43M, and 43K charge the photoconductor drum 41 for each color, and an optical writing unit 42 writes latent images of each color on the photoconductor drum 41, and the developing rollers 44Y, 44C, 44M, and 44K develop latent images as toner images of each color. The toner images superimposed on the photoconductor drum 41 receive toner charge adjustment by a charging device 48, and then transferred to the recording medium P transported by the transport belt 3. After such transfer process, a cleaning unit 45 removes toner remaining on the recording medium P. Different from other configurations using four photoconductor drums arranged in tandem, such image forming engine 4*b* uses only one photoconductor drum, by which the number of parts can be reduced, and an image transfer process is conducted one time. Further, reverse transfer phenomenon that toner is transferred from an intermediate transfer member to a photoconductor during a transfer process can be reduced, by which toner consumption can be reduced.

As above described, the image forming apparatus 100*b* according to the fifth exemplary embodiment can decrease glossiness of toner image after re-heating compared to glossiness of toner image before re-heating, wherein such toner image is already fixed on the recording medium P by applying heat in the fixing unit 5.

Further, because the temperature condition of toner image can be easily controlled with such re-heating configuration even if some changes occur on an installation environment of apparatus, glossiness of output image can be set to a given preferable level reliably.

With such configuration, graininess of toner image formed on recording media having different glossiness can be set to a given preferable level and evenness of glossiness of image can be set to a given preferable level.

In the above-described image forming apparatus according to example embodiments, glossiness of toner image fixed on a recording medium can be decreased after re-heating process compared to glossiness of toner image before re-heating, in which the toner image is fixed on the recording medium by a fixing unit and then the toner image is re-heated by a re-heating unit.

With such configuration, graininess of toner image formed on recording media having different glossiness can be set to a given preferable level and evenness of glossiness of image can be set to a given preferable level.

In the above-described image forming apparatus according to example embodiments, glossiness of toner image formed on a recording medium is changed from a higher glossiness level to a middle to lower glossiness level to produce an image having a desired glossiness. In such configuration, degradation of graininess of toner image formed on a recording medium can be reduced or prevented.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a fixing unit configured to fix a toner image on a recording medium by applying heat to the toner image, the toner image being fixed with a first glossiness level, wherein the fixing unit includes a first contact member to contact the toner image;

a re-heating unit configured to re-heat the toner image, fixed on the recording medium by the fixing unit, to set a second glossiness level being lower than the first glossiness level, wherein the re-heating unit includes a second contact member to contact the toner image, wherein a surface roughness of the second contact member is greater than a surface roughness of the first contact member, the re-heating unit including a plurality of re-heating devices; and a controller configured to control which of the re-heating devices are used by the re-heating unit, based on a type of the recording medium.

2. The image forming apparatus according to claim 1, wherein the re-heating unit includes at least one re-heating device to re-heat the toner image without contacting the re-heating device against the toner image on the recording medium.

3. The image forming apparatus according to claim 1, wherein the re-heating unit includes at least one re-heating device to re-heat the toner image on the recording medium while applying pressure to the toner image.

4. The image forming apparatus according to claim 1, wherein the plurality of re-heating devices set different glossiness levels for the second glossiness level having lower glossiness than the first glossiness level.

5. The image forming apparatus according to claim 4, wherein each of the plurality of re-heating devices includes a contact member configured to contact the toner image on the recording medium, each of the contact members having a different surface roughness to set a different glossiness level for the second glossiness level.

6. The image forming apparatus according to claim 4, further comprising an operation unit configured to select the plurality of re-heating devices.

7. The image forming apparatus according to claim 4, further comprising a detector configured to detect types of the recording medium, and any one of the plurality of re-heating devices is selected based on a detection result of the detector.

8. The image forming apparatus according to claim 7, wherein the detector is a glossiness detector configured to detect glossiness of the recording medium, and any one of the plurality of re-heating devices is selected based on a detection result of the glossiness detector.

9. The image forming apparatus according to claim 1, wherein, when the recording medium has a 60-degree specular glossiness value of 5% or less, the toner image is not cooled and separated by the first contact member.

10. The image forming apparatus according to claim 1, wherein, when the recording medium has a 60-degree specular glossiness value of 80% to 100%, the toner image is not re-heated by the re-heating unit.

11. The image forming apparatus according to claim 1, further comprising:

an image carrying member configured to carry a plurality of toner images, developed and superimposed thereon; and a transfer device configured to transfer the plurality of toner images from the image carrying member to the recording medium.

12. An image forming apparatus, comprising:

a fixing unit configured to fix a toner image on a recording medium by applying heat to the toner image, the toner image being fixed with a first glossiness level; and a re-heating unit configured to re-heat the toner image, fixed on the recording medium by the fixing unit, to set a second glossiness level being lower than the first glossiness level, wherein the re-heating unit includes a plurality of re-heating devices to set different glossiness levels as the second glossiness level.

* * * * *